US010961719B2

(12) United States Patent
Doupe et al.

(10) Patent No.: US 10,961,719 B2
(45) **Date of Patent: *Mar. 30, 2021**

(54) DECKING CLIP

(71) Applicant: KLEVAKLIP SYSTEMS PTY LTD., Cromer (AU)

(72) Inventors: Greg James Doupe, Cromer (AU); Stephen Ley Sanders, Cromer (AU)

(73) Assignee: KLEVAKLIP SYSTEMS PTY LTD., Cromer (AU)

( * ) Notice: Subject to any disclaimer, the term of this patent is extended or adjusted under 35 U.S.C. 154(b) by 548 days.

This patent is subject to a terminal disclaimer.

(21) Appl. No.: 15/899,421

(22) Filed: Feb. 20, 2018

(65) Prior Publication Data

US 2018/0238060 A1 Aug. 23, 2018

(30) Foreign Application Priority Data

Feb. 21, 2017 (AU) ..... 2017900570

(51) Int. Cl.
*E04F 15/02* (2006.01)
*E04F 15/10* (2006.01)
(Continued)

(52) U.S. Cl.
CPC ..... *E04F 15/02183* (2013.01); *E04F 13/081* (2013.01); *E04F 15/04* (2013.01);
(Continued)

(58) Field of Classification Search
CPC ..... E04F 2015/02094; E04F 15/02183; E04F 2201/0535
(Continued)

(56) References Cited

U.S. PATENT DOCUMENTS 4,078,515 A * 3/1978 Svirklys ..... E02B 3/064 114/266
5,048,448 A * 9/1991 Yoder ..... E02B 3/068 114/263
(Continued)

FOREIGN PATENT DOCUMENTS

AU 2005202812 A1 1/2006
CA 2943485 A1 * 9/2015 ..... E04B 5/023
(Continued)

OTHER PUBLICATIONS

Office Action from corresponding Australian Application No. 2018201248 dated May 6, 2019.

*Primary Examiner* — Robert Canfield
(74) *Attorney, Agent, or Firm* — Lando & Anastasi, LLP

(57) ABSTRACT

A decking clip to allow a plurality of decking members to be attached relative to a support assembly, the decking clip including an elongate plastic body strip having a body length, the body provided with a number of openings to receive fasteners there through to attach the body relative to the support assembly; a number of upstands spaced over the body length and extending substantially perpendicularly from the body strip, substantially transversely to the body length; each upstand having at least two opposed decking board engagement arms, a first decking board engagement arm extending from a first lateral side of each upstand at an acute angle and a second decking board engagement arm extending from a second lateral side of each upstand at an acute angle, each upstand and/or engagement arm being resiliently deformable to allow portion of a decking board to pass and to retain the decking board relative to the support assembly in a spaced apart, non-overlapping configuration.

15 Claims, 4 Drawing Sheets

(51) Int. Cl.
*E04F 15/04* (2006.01)
*E04F 13/08* (2006.01)

(52) U.S. Cl.
CPC ..... *E04F 15/102* (2013.01); *E04F 15/105* (2013.01); *E04F 2015/02094* (2013.01); *E04F 2201/0517* (2013.01); *E04F 2201/0535* (2013.01)

(58) Field of Classification Search
USPC ..... 52/489.1, 489.2, 582.1, 582.2, 177, 715, 52/547
See application file for complete search history.

(56) References Cited

U.S. PATENT DOCUMENTS 5,493,831 A * 2/1996 Jansson ..... E06B 3/5427 52/204.593
5,553,427 A * 9/1996 Andres ..... E04B 5/026 52/177
5,845,446 A * 12/1998 Funaki ..... E04D 3/366 52/461
5,950,377 A * 9/1999 Yoder ..... E04F 15/10 52/177
5,953,878 A * 9/1999 Johnson ..... B63B 5/24 256/19
6,112,479 A * 9/2000 Andres ..... E04F 15/10 52/177
6,233,886 B1 * 5/2001 Andres ..... E01O 5/005 114/267
8,146,303 B2 * 4/2012 Gibson ..... E04F 15/10 52/177
9,003,736 B2 * 4/2015 Schoneveld ..... E04F 15/02005 52/582.1
9,416,546 B2 * 8/2016 Claudin ..... E04B 1/40
9,458,635 B1 * 10/2016 Anic ..... E04F 15/02166
10,119,273 B2 * 11/2018 Andres ..... E04F 13/0819
10,633,870 B2 * 4/2020 Pervan ..... B32B 27/304
2003/0154662 A1 * 8/2003 Bruchu ..... E04F 15/10 52/87
2004/0045244 A1 * 3/2004 Hafner ..... E04B 5/12 52/489.1
2006/0117688 A1 * 6/2006 Hauck ..... E04D 13/0477 52/302.1
2009/0094925 A1 4/2009 Andres et al.
2010/0011687 A1 * 1/2010 Arias ..... E06B 3/5427 52/235
2010/0146900 A1 * 6/2010 Holland ..... E04F 15/02 52/650.3
2012/0227348 A1 9/2012 Turner
2013/0025228 A1 * 1/2013 Kilgore ..... E04F 15/04 52/578
2013/0025230 A1 * 1/2013 Turner ..... E04F 15/02183 52/586.1
2015/0096256 A1 * 4/2015 Lam ..... E04F 15/02044 52/582.1
2019/0136546 A1 * 5/2019 Doupe ..... E04F 15/02022

FOREIGN PATENT DOCUMENTS

CA 2947656 A1 * 11/2015 ..... E04F 13/18
DE 202012102579 U1 * 8/2012 ..... E04F 13/0826
EP 3282066 A1 * 2/2018 ..... E04F 15/2183
GB 2574799 A * 12/2019 ..... E04B 1/003
WO 2007051934 A1 5/2007
WO WO-2007051934 A1 * 5/2007 ..... E04F 15/02044
WO 2014179838 A1 11/2014
WO WO-2014179838 A1 * 11/2014 ..... E04F 15/02044

* cited by examiner

DECKING CLIP

CROSS-REFERENCE TO RELATED APPLICATION

This application claims the benefit under 35 U.S.C. § 119 of Australian Patent Application No. 2017900570 filed on Feb. 21, 2017 which is hereby incorporated herein by reference in its entirety for all purposes.

TECHNICAL FIELD

The present invention relates to decking and particularly to a decking clip or fastener allowing a number of decking boards to be laid quickly and easily but also be securely laid.

BACKGROUND ART

Wood-Plastic Composite (WPC) decking boards have been in the marketplace around the world since the mid 1990's and arguably account for approximately 10% of the world decking market.

Despite the fact that the WPC's are generally more expensive than all but the most expensive timber, they have achieved huge inroads due to their perceived advantages—being: —

Low maintenance (very good "life cost" value)

Very stable (won't warp or twist)

Environmentally friendly

Long lasting splinter and rot resistant

Being a man made "extruded" product, it is possible to make any shape that may be made via conventional plastics profile extrusion. Whilst most decking boards are substantially rectangular in the shape of a standard decking board, because of the inherent stability of the board it has become fairly standard to extrude boards with grooves in the side of the board such as that illustrated in FIG. 2 to allow a "biscuit-type" fixing to be used to hold down the boards from the sides—thus eliminating the need for screws and nails to be used through the top of the board. This makes for a very aesthetically pleasing look to the deck as the fixing is substantially "hidden". Biscuit clips are generally made from some type of plastic—they come in a large range of "proprietary" shapes and sizes but substantially have a centre section where the screw goes through, and a wing on each side that sits into the groove of the decking-board on either side of the clip. One example of a biscuit clip is shown in FIG. 3 and the general arrangement of the attachment is illustrated in FIG. 1.

However, biscuit clips tend to be quite fiddly due to having to fit the "biscuit" into the groove in the board and the drive a very small headed screw in between the boards. It is a two-part process as the screws cannot be fully tightened until the following board is laid.

Most screws used in the biscuit clip systems are specific, and are not suitable for use with either hardwood or steel joist systems making them very difficult to use in at least one of these environments depending on which screw is fitted to the biscuit clip in the manufacturing process.

Biscuit clips generally require "double joist" to be used at butt joins due to the minimal holding length of the biscuit.

It will be clearly understood that, if a prior art publication is referred to herein, this reference does not constitute an admission that the publication forms part of the common general knowledge in the art in Australia or in any other country.

SUMMARY OF INVENTION

The present invention is directed to a decking clip, which may at least partially overcome at least one of the above-mentioned disadvantages or provide the consumer with a useful or commercial choice.

With the foregoing in view, the present invention in one form, resides broadly in a decking clip to allow a plurality of decking members to be attached relative to a support assembly, the decking clip including an elongate plastic body strip having a body length, the body provided with a number of openings to receive fasteners there through to attach the body relative to the support assembly, a number of upstands spaced over the body length and extending substantially perpendicularly from the body strip, substantially transversely to the body length, each upstand having at least two opposed decking board engagement arms, a first decking board engagement arm extending from a first lateral side of each upstand at an acute angle and a second decking board engagement arm extending from a second lateral side of each upstand at an acute angle, each upstand and/or engagement arm being resiliently deformable to allow portion of a decking board to pass and to retain the decking board relative to the support assembly in a spaced apart, non-overlapping configuration.

The decking clip of the present invention is preferably made from plastic material and in particular, and engineering plastic is preferably used. One particularly preferred plastic material is nylon 6. A preferred embodiment of the decking clip may be manufactured from impact modified or glass filled nylon or have impact modified or glass filled nylon added to nylon 6.

An advantage of using a plastic material is that the decking clip will be relatively easy to trim to length, typically using a saw, sharp knife or similar implement such as a snips, tin snips or scissors for example.

The decking clip of a preferred embodiment will typically attach more than one decking board relative to the support assembly. The decking clip is generally attached to the support assembly, normally to one of the joists. Preferably, the decking clip is attached substantially centrally on the joist and one or more decking clips are provided in an end-to-end configuration extending substantially over the length of each joist in the support assembly. Aligned decking clips can then be provided on one or more neighbouring joists.

In a preferred embodiment, the decking clip will typically function to attach multiple decking boards, individually relative to the support assembly, using a snap fit action such that the boards can be fitted one at a time to the decking clip. The decking clip of a preferred embodiment will also function to space adjacent decking boards from one another. In a preferred embodiment, the decking clip will also act to align the decking boards with one another.

Normally, the decking clip of the present invention is used with decking boards having a longitudinal groove or step provided on at least one and typically both side edges of each decking boards. The engagement arms of the decking clip of the present invention will typically act to abut the periphery of the longitudinal groove or the step if the decking board attempts to move upwardly.

The decking clip of the present invention includes an elongate plastic body strip having a body length, the body provided with a number of openings to receive fasteners there through to attach the body relative to the support assembly.

The plastic body strip is typically elongate and between approximately 0.5 m and 1 m in length but normally, will be approximately 0.7 m in length. The body strip will typically be substantially rectangular when viewed in plan. The plastic body strip is preferably substantially planar with the upstands standing proud of the plastic body strip.

A shaped key assembly is preferably provided at one end of the plastic body strip and a correspondingly shaped keyway assembly is preferably provided at the other end of the plastic body strip. The preferred key assembly and keyway assembly will be provided as partial thickness portions extending only part of the height of the plastic body. The key assembly preferred will typically be located as a half thickness portion at an upper side of the body strip and the keyway assembly preferably provided as a half thickness portion at a lower side of the body strip. In use, the shaped key assembly of a first decking clip will normally be aligned with the shaped keyway assembly of an adjacent decking clip during the attachment process. Preferably, the shaped key assembly will be substantially trapezoidal in shape and the shaped keyway assembly will have a corresponding shape. Providing a trapezoidal shape will typically assist with the alignment of the key assembly with the keyway assembly and proper alignment of the key assembly with the keyway assembly will also assist with the correct spacing between adjacent upstands on different decking clips.

In a preferred embodiment, at least one opening will be provided through the key assembly and the keyway assembly. When the key assembly and the keyway assembly are aligned, preferably at least one opening in each will be aligned to allow a fastener to extend through the aligned key assembly and the keyway assembly.

A number of openings are provided in the elongate plastic body strip for fasteners to attach the elongate body strip to the support assembly. Preferably, the openings will be spaced evenly over the length of the elongate plastic body strip. In a preferred embodiment, at least one opening is provided on each side of each upstand and preferably, a pair of openings is provided on each side of each upstand which will act to fix the body strip to the support assembly immediately adjacent each of the upstand is on both sides of the upstand.

Openings provided in the body strip for fasteners may have a shaped periphery in order to accept a screw fastener closely. Preferably, openings provided to attach the elongate body strip to the support assembly are provided in a recessed central portion.

A raised portion is preferably provided along each side edge of the body strip on an upper side of the body strip, to provide the body strip with raised side edges and a recessed or lower level, lower height central portion. The raised portions will typically form rest surfaces for an underside of decking members when attached. The height of the raised portions will typically be optimised relative to the lower end of the engagement arms to account for the particular thickness of the decking board used. In other words, the dimension between an upper side of the raised portion and the lower end of the engagement arms should be approximately equal to the thickness of the decking board between the base of the decking board and the lower side of the peripheral groove or step provided on the longitudinal edge of the decking board.

The upstand may also be provided on or extending from a raised portion. In a preferred configuration, the raised portion from which the upstand extends will typically be oriented transversely to the raised portions extending along each side edge of the body strip. Again, the raised portions will preferably define a number of recessed central portions over the length of the body strip with the openings for fasteners typically provided in the recessed central portions.

One or more gaps will preferably be provided between raised portions extending along each side edge of the body strip. Typically, at least one gap will be provided in each raised portion between adjacent upstands. The provision of at least one gap in this location will preferably allow water to drain from be decking clip if water manages to reach this position and/or to allow air to flow underneath the decking board.

A transversely extending attachment plate will normally be provided between adjacent upstands. Portions will typically be removed from either side of the attachment plate to form openings, in order to reduce the amount of material used to form the elongate body strip. In a preferred form, the least one gap provided in each raised portion between adjacent upstands will preferably be provided adjacent to the attachment plate. The attachment plate will normally have at least one opening therethrough to receive a fastener to assist with attachment of the body strip relative to the support assembly.

The decking clip of the present invention also includes a number of upstands spaced over the body length and extending substantially perpendicularly from the body strip, substantially transversely to the body length. As mentioned above, in a preferred form, each upstand will extend from a transversely extending raised portion. Each upstand will preferably include a thickened base portion, which provides strength to the upstand and a thinner upper portion. An angled transition is typically provided between the thickened base portion and the thinner upper portion, preferably angled outwardly and downwardly.

Each upstand will typically be generally rectangular when viewed in elevation. Each upstand will typically have arcuate outer corners between a substantially planar side edge and a substantially planar top edge. Each of the upstands will typically be substantially planar albeit preferably of portions of different thickness.

Each upstand will preferably extend substantially 90° to the plane of the body strip. Each upstand will preferably extend transversely across the body strip at approximately 90°.

The upstands are preferably regularly spaced from one another. In use, a decking board of one or more standard widths will be provided and preferably, the separation distance between the respective upstands on a particular decking clip is slightly greater than the board width that will be attached to the decking clip in order to allow for the engagement arms.

Typically, four to six decking boards will be attached per decking clip although there could be fewer or more decking boards provided depending upon the length of the body strip, and the width of the decking boards used. However, the decking clip will be manufactured for decking boards of a specific width although the decking clip may be manufactured in a number of different embodiments to suit different width decking boards or different decking board widths on the same decking clip to form a pattern for example.

Generally, four to six upstands are provided on each of the preferred decking clips, spaced equally over the length of the body strip. It is preferred that the upstands at either end of the decking clip are spaced from the terminal end of the body strip such that when two decking clips are located on a support assembly with the key assembly properly located in the keyway assembly, the dimension between adjacent upstands is maintained for the decking board width.

Each upstand may be resiliently deformable, preferably to a small degree in order to allow passage of a portion of the decking board during attachment of the decking boards but preferably, the upstands are substantially rigid and it is the engagement arms which are very slightly resiliently deformable.

Each upstand of the decking clip will preferably have at least two opposed decking board engagement arms, a first decking board engagement arm extending from a first lateral side of each upstand at an acute angle and a second decking board engagement arm extending from a second lateral side of each upstand at an acute angle, each upstand and/or engagement arm being resiliently deformable to allow portion of a decking board to pass and to retain the decking board relative to the support assembly in a spaced apart, non-overlapping configuration.

One or more engagement arms can be provided on each side of the upstand. There may be two engagement arms provided in a spaced apart configuration on each side of the upstand or a single engagement arm on each side of each upstand may be provided. The provision of two engagement arms on each side of the upstand with a slot between them gives similar holding power to one arm, but reduces stress on each engagement arm when a board is inserted (especially at cold temperatures), so there is less chance of an engagement arm being broken.

It is also preferred that the engagement arms do not extend the full width of the upstand. In particular, it is preferred that the end edges of the engagement arms are typically spaced inwardly from the side edges of the upstand. It is preferred that the end edges of the engagement arms are substantially planar rather than arcuate.

Each engagement arm will preferably have a bottom edge which is substantially parallel to the plane of the body. Each engagement arm will typically have an upper edge which is coplanar with the top of the upstand. In the particularly preferred embodiment in which the engagement arm and upstand are moulded in a single piece, the upper periphery of the engagement arms is typically coplanar with the top edge of the upstand.

Each engagement arm is preferably provided at an acute angle relative to the upstand. Although any angle can be used, an angle of approximately 15° to 35° with an angle of approximately 30° from the upstand is particularly preferred. Each engagement arm will preferably extend outwardly and downwardly toward the body strip.

The decking clip of the preferred embodiment is typically manufactured in one piece with all parts integrally formed. This is normally achieved by a moulding process.

In use, the decking clip will typically be attached to an upper planar edge of a joist or other surface in a support assembly and then one or more adjacent decking clips provided in an end-to-end configuration. A decking board with a groove or step in a side edge can then be provided at an angle to locate the groove or step in one side edge relative to an engagement arm on one upstand. This will normally cause the underside of the decking board to rest on the engagement arm on an adjacent upstand at which time force can be applied to an upper surface of the decking board to force the decking board downwardly. This will have the effect of temporarily and resiliently deformable one or both of the upstand and/or the at least one engagement arm while the decking board passes the engagement arm and engagement arm will then enter the groove or step in the side edge of the decking board and engagement arm will preferably abut an upper surface of the periphery of the groove or step in the side edge of the decking board to hold the decking board to the support assembly. The preferred substantially parallel lower edge of the engagement arm will resist any upward movement of the decking board.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

According to a particularly preferred embodiment of the present invention, a decking clip is provided.

Figure 1:
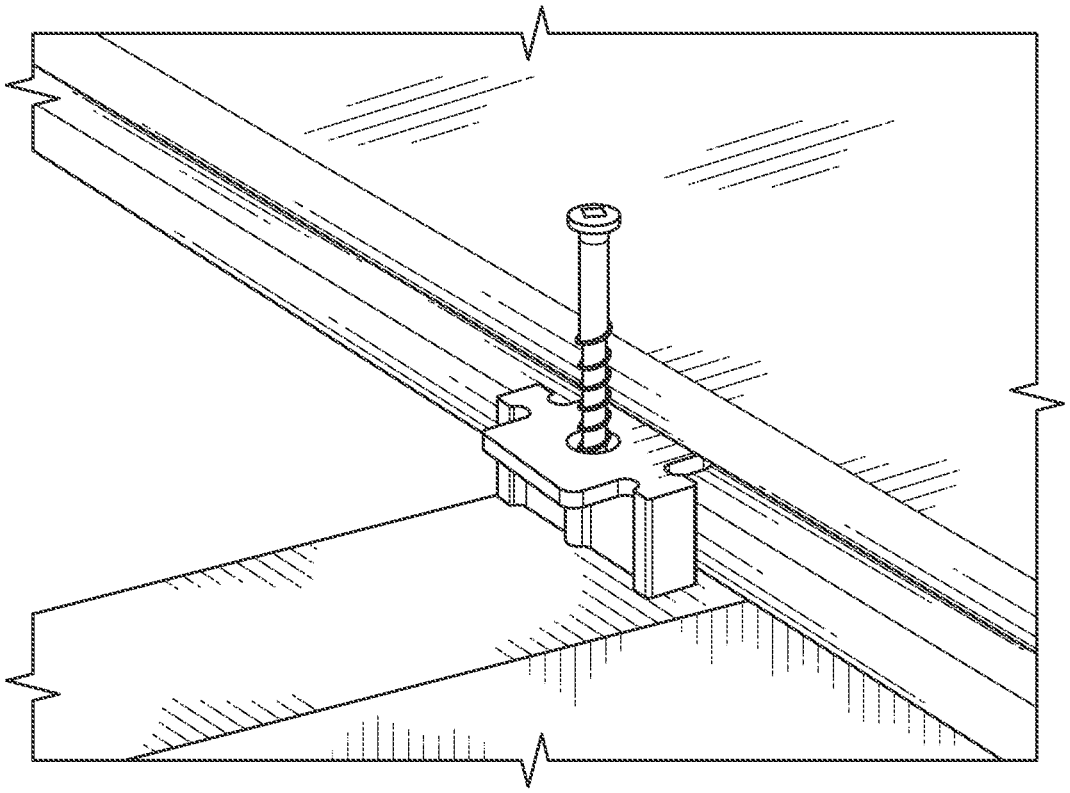
FIG. 1 (Prior Art)
FIG. 1 is an isometric view of a prior art attachment system between a joist in the decking boards including a biscuit clip.
Figure 2:
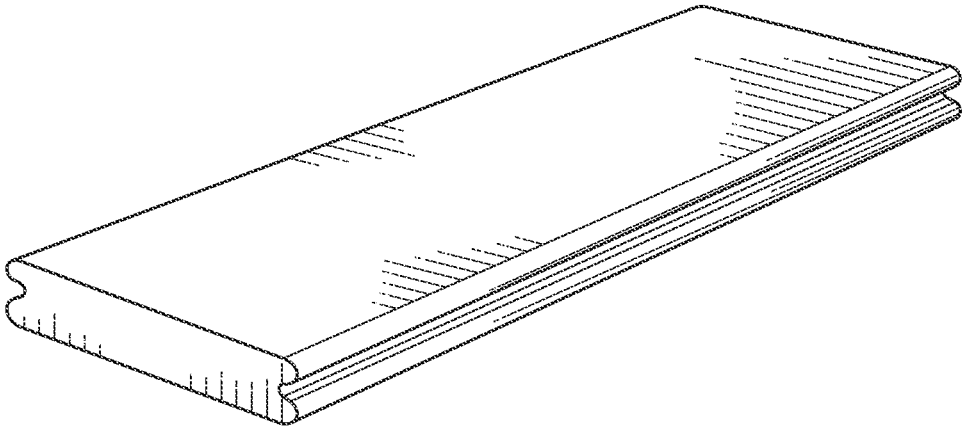
FIG. 2 (Prior Art)
FIG. 2 is an isometric view of a prior art decking board used in the configuration illustrated in FIG. 1.
Figure 3:
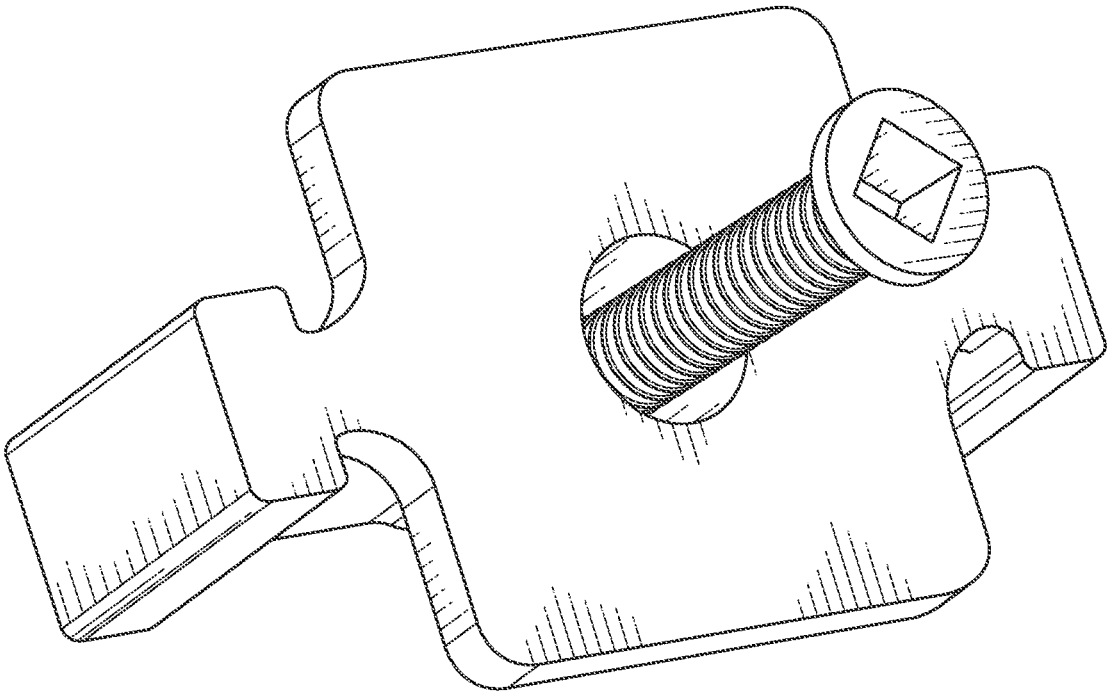
FIG. 3 (Prior Art)
FIG. 3 is an isometric view of a prior art biscuit clip used in the configuration illustrated in FIG. 1.

The decking clip 10 allows a plurality of decking members as illustrated in FIG. 2 to be attached relative to a support assembly by mounting the decking clip, generally a number of decking clips, in an end to end configuration on adjacent joists and then laying the decking members relative to the decking clips.

The decking clip 10 of the illustrated preferred embodiment includes an elongate plastic body strip 11 having a body length. The body strip 11 is provided with a number of openings 12 to receive fasteners (not shown) therethrough to attach the body strip 11 relative to the support assembly. The preferred embodiment also includes a number of upstands 13 spaced over the body length and extending substantially perpendicularly from the body strip 11, substantially transversely to the body length, each upstand 13 having at least two opposed decking board engagement arms 14, a first decking board engagement arm extending from a first lateral side of each upstand 13 at an acute angle and a second decking board engagement arm extending from a second lateral side of each upstand 13 at an acute angle, each upstand 13 and/or engagement arm 14 being resiliently deformable to allow portion of a decking board to pass and to retain the decking board relative to the support assembly in a spaced apart, non-overlapping configuration.

The decking clip 10 of the preferred embodiment is preferably made from plastic material and in particular, and engineering plastic is preferably used. One particularly preferred plastic material is nylon 6. A preferred embodiment of the decking clip may be manufactured from impact modified or glass filled nylon or have impact modified or glass filled nylon added to nylon 6.

The decking clip of a preferred embodiment will typically attach more than one decking board relative to the support assembly, normally transversely to the decking clips in the spaces between adjacent upstands 13. The decking clip 10 is generally attached to the support assembly, normally to one of the joists. Preferably, the decking clip is attached substantially centrally of the joist and one or more decking clips 10 are provided in an end-to-end configuration extending substantially over the length of each joist in the support assembly. Any fastening mechanism may be used to attach the decking clip to the support assembly including nails and/or screws and the like.

In a preferred embodiment, the decking clip 10 will typically function to attach multiple decking boards individually relative to the support assembly using a snap fit action such that the boards can be fitted one at a time to the decking clip 10. The decking clip of the preferred embodiment will also function to space adjacent decking boards from one another and also act to align the decking boards with one another for a consistent appearance.

Normally, the decking clip of the present invention is used with decking boards having a longitudinal groove provided on at least one and typically both side edges of each decking boards as illustrated in FIG. 2. The engagement arms 13 of the decking clip 10 of the preferred embodiment will typically act to abut the periphery of the longitudinal groove if the decking board attempts to move upwardly.

Figure 4:
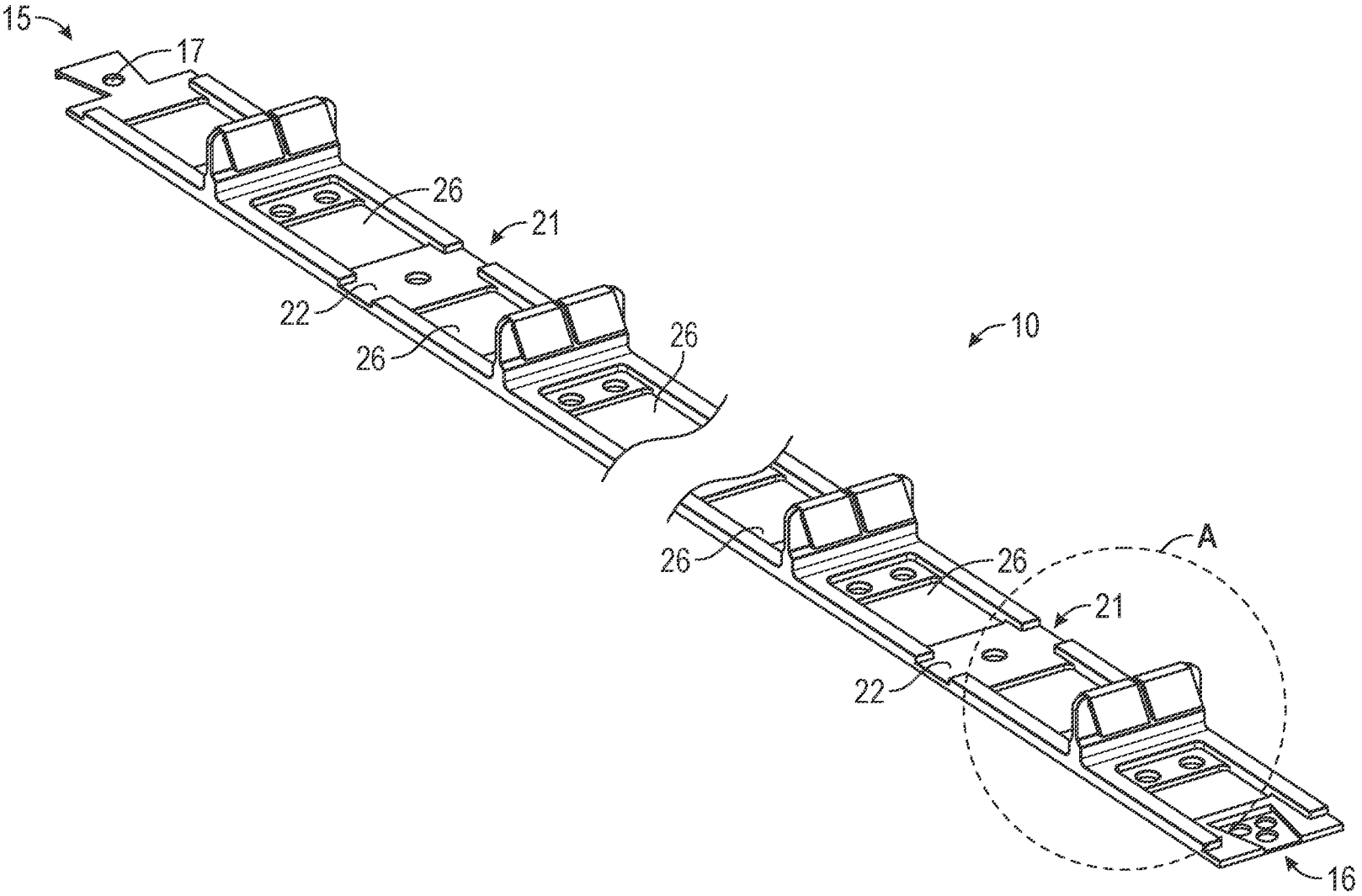
FIG. 4 is an isometric view of a decking clip according to a preferred embodiment of the present invention.

The plastic body strip 11 is typically elongate and between approximately 0.5 m to 1 m in length but normally, will be approximately 0.7 m in length. The body strip 11 will typically be substantially rectangular when viewed in plan as seen in FIG. 4 in particular. The plastic body strip 11 is preferably substantially planar with the upstands 13 standing proud of the plastic body strip 11.

In the illustrated embodiment, a shaped key assembly 15 is provided at one end of the plastic body strip 11 and a correspondingly shaped keyway assembly 16 is provided at the other end of the plastic body strip 11. The preferred key assembly 15 and keyway assembly 16 are provided as partial thickness portions extending only part of the height of the plastic body 11. The key assembly 15 is located as a half thickness portion at an upper side of the body strip 11 at one end of the body strip 11 and the keyway assembly 16 is provided as a half thickness portion at a lower side of the body strip at the other end of the body strip 11. In use, the shaped key assembly 15 of a first decking clip will normally be aligned with the shaped keyway assembly 16 of an adjacent decking clip during the attachment process. Preferably, the shaped key assembly 15 is substantially trapezoidal in shape as illustrated in FIG. 4 and the shaped keyway assembly 16 will have a corresponding shape. Providing a trapezoidal shape will typically assist with the alignment of the key assembly 15 with the keyway assembly 16 and proper alignment of the key assembly 15 with the keyway assembly 16 will also assist with the correct spacing between adjacent upstands 13 on different decking clips 10 where multiple decking clips are used.

In the preferred embodiment illustrated, an opening 17 is provided through the key assembly 15 and at least one alignable opening is provided through the keyway assembly 16. When the key assembly 15 and the keyway assembly 16 are aligned, preferably the openings in each will be aligned to allow a fastener to extend through the aligned key assembly 15 and the keyway assembly 16.

A number of openings 12 are provided in the elongate plastic body strip 11 for fasteners to attach the elongate body strip 11 to the support assembly. Preferably, the openings 12 will be spaced evenly over the length of the elongate plastic body strip 11. In a preferred embodiment, a pair of openings 12 is provided on each side of each upstand 11 which will act to fix the body strip 11 to the support assembly immediately adjacent each of the upstands 13 on both sides of each upstand 13.

Openings 12 for fasteners provided in the body strip 11 may have a shaped periphery in order to accept a screw fastener closely. Preferably, the openings 12 provided to attach the elongate body strip 11 to the support assembly are provided in a recessed central portion 18.

A raised portion 19 is preferably provided along each side edge of the body strip 11 on an upper side of the body strip 11, to provide the body strip 11 with raised side edges and a recessed or lower level, lower height central portion 18. The raised portions 19 also form rest surfaces for an underside of decking members when attached. The height of the raised portions 19 will typically be optimised relative to the lower end of the engagement arms 14 to account for the particular thickness of the decking board used. In other words, the dimension between an upper side of the raised portion 19 and the lower end of the engagement arms 14 should be approximately equal to the thickness of the decking board between the base of the decking board and the lower side of the peripheral groove provided on the longitudinal edge of the decking board.

The upstand 11 is also provided on or extending from a raised portion 20. In a preferred configuration, the raised portion 20 from which the upstand 13 extends is oriented transversely to the raised portions 19 extending along each side edge of the body strip 11. Again, the raised portions 19, 20 will preferably define a number of recessed central portions 18 over the length of the body strip 11 with the openings 12 for fasteners typically provided in the recessed central portions 18.

One or more gaps 21 will preferably be provided between raised portions 19 extending along each side edge of the body strip 11. In the illustrated embodiment, one gap 21 is provided between adjacent upstands 13. The provision of the gap 21 in this location will preferably allow water to drain from be decking clip 10 if water manages to reach this position and/or to allow air to flow underneath the decking board.

A transversely extending attachment plate 22 will normally be provided between adjacent upstands 13. Portions will typically be removed from either side of the attachment plate 22 to form openings 26 in order to reduce the amount of material used to form the elongate body strip 11. In a preferred form, the gap 21 provided in each raised portion 19 between adjacent upstands 13 will preferably be provided adjacent to the attachment plate 22. The attachment plate will normally have an opening 23 therethrough to receive a fastener to assist with attachment of the body strip 11 relative to the support assembly.

Figure 5:
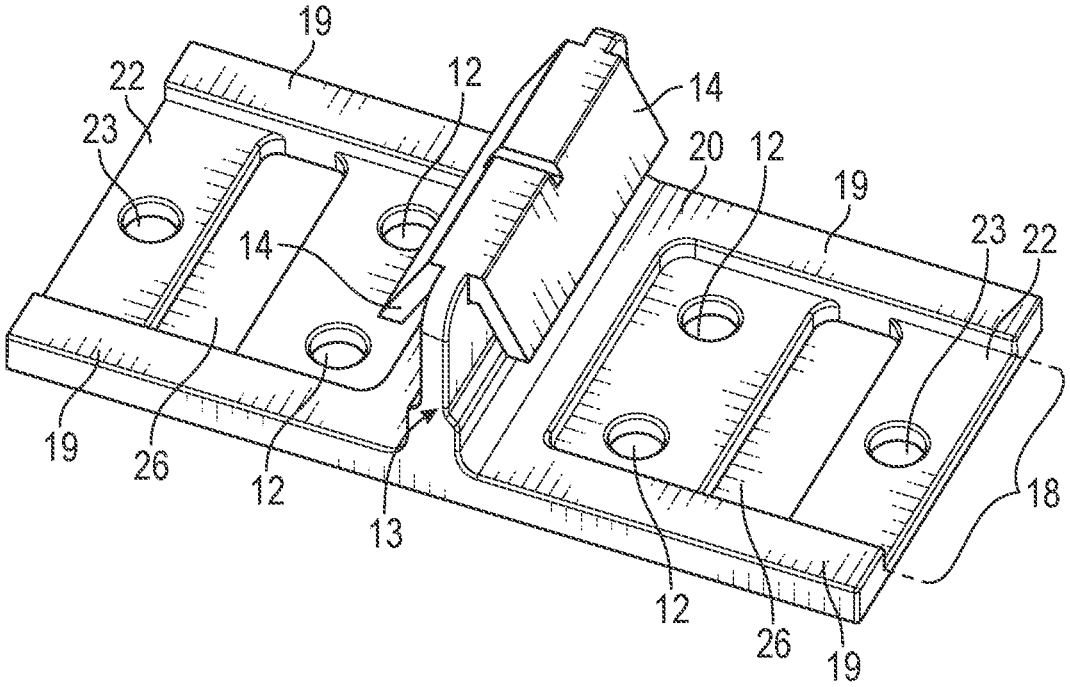
FIG. 5 is an isometric view of a portion of the decking clip illustrated in FIG. 4 and identified by reference letter "A".

As mentioned above, in a preferred form, each upstand 13 will extend from a transversely extending raised portion 20. As illustrated in FIG. 5, each upstand 13 includes a thickened base portion 24 and a thinner upper portion 25. An angled transition is typically provided between the thickened base portion 24 and the thinner upper portion 25, preferably angling outwardly and downwardly.

Each upstand 13 will typically be generally rectangular when viewed in elevation. Each upstand 13 will typically have an arcuate outer corners between a substantially planar side edge and a substantially planar top edge. Each of the upstands 13 will typically be substantially planar albeit preferably of portions of different thickness.

Each upstand 13 will preferably extend substantially 90° to the plane of the body strip 11 and extend transversely across the body strip 11 at approximately 90°.

The upstands 13 are preferably regularly spaced from one another. In use, a decking board of one or more standard widths will be provided and preferably, the separation distance between the respective upstands 13 on a particular decking clip is slightly greater than the board width that will be attached to the decking clip 10 in order to allow for the engagement arms 14.

Typically, four to six decking boards will be attached per decking clip 10 although there could be fewer or more decking boards provided depending upon the length of the body strip 11, and the width of the decking boards used. However, the decking clip 10 will be manufactured for decking boards of a specific width although the decking clip 10 may be manufactured in a number of different embodiments to suit different width decking boards.

Generally, four to six upstands 13 are provided on each of the decking clips 10, spaced equally over the length of the body strip 11. It is preferred that the upstands at either ends of the body strip 11 are spaced from the terminal end of the body strip 11 such that when two decking clips 10 are located on a support assembly with the key assembly 15 properly located in the keyway assembly '6, the dimension between adjacent upstands 13 is maintained for the decking board width.

Each upstand 13 may be resiliently deformable, preferably to a small degree in order to allow passage of a portion of the decking board during attachment of the decking boards but preferably, the upstands 13 are substantially rigid and it is the engagement arms 14 which are very slightly resiliently deformable.

One or more engagement arms 14 can be provided on each side of the upstand 13. Preferably, there will be two engagement arms provided in a spaced apart configuration on each side of the upstand or a single engagement arm 14 on each side of each upstand 13 as illustrated in FIG. 5 may be provided.

It is also preferred that the engagement arms 14 do not extend the full width of the upstand 13. In particular, it is preferred that the end edges of the engagement arms 14 are typically spaced inwardly from the side edges of the upstand 13 as can clearly be seen in FIG. 5. It is preferred that the end edges of the engagement arms 14 are substantially planar rather than arcuate.

Figure 6:
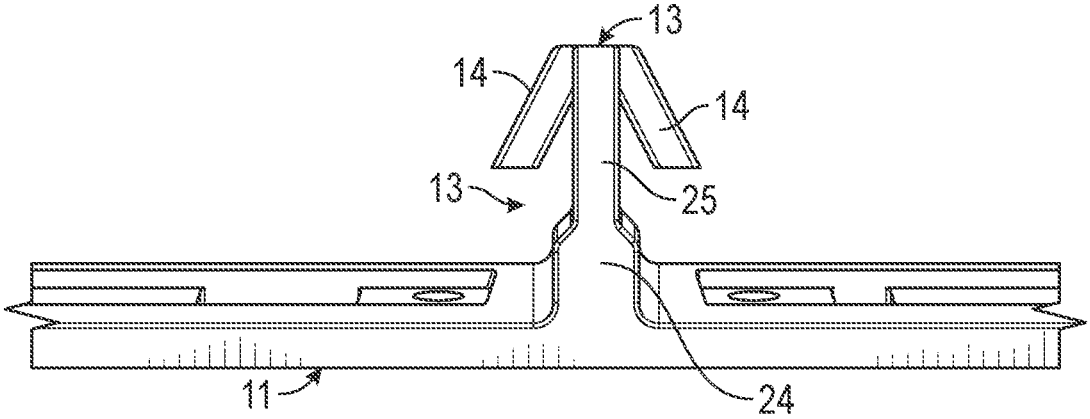
FIG. 6 is a side elevation view of the portion illustrated in FIG. 5.

Each engagement arm 14 will preferably have a bottom edge which is substantially parallel to the plane of the body strip 11 as shown in FIG. 6. Each engagement arm 14 will typically have an upper edge which is coplanar with the top of the upstand 13. In the particularly preferred embodiment in which the engagement arm 14 and upstand 13 are moulded in a single piece, the upper periphery of the engagement arms 14 is typically coplanar with the top edge of the upstand 13.

Each engagement arm 14 is preferably provided at an acute angle relative to the upstand 13. Although any angle can be used, and angle of approximately 30° from the upstand 13 is particularly preferred. Each engagement arm 14 will preferably extend outwardly and downwardly toward the body strip 11.

The decking clip 10 of the preferred embodiment is typically manufactured in one piece with all parts integrally formed. This is normally achieved by a moulding process.

In use, the decking clip 10 will typically be attached to an upper planar edge of a joist or other surface in a support assembly and then one or more adjacent decking clips 10 provided in an end-to-end configuration. Normally, aligned decking clips will be provide on adjacent joists. A decking board with a groove or step in a side edge can then be provided at an angle to locate the groove in one side edge relative to an engagement arm 14 on one upstand 13. This will normally cause the underside of the decking board to rest on the engagement arm 14 on an adjacent upstand 13 at which time force can be applied to an upper surface of the decking board to force the decking board downwardly. This will have the effect of temporarily and resiliently deforming one or both of the upstand 13 and/or the at least one engagement arm 14 while the decking board passes the engagement arm 14 and the lower, outer part of the engagement arm 14 will then enter the groove or step in the side edge of the decking board and engagement arm 14 will preferably abut an upper surface of the periphery of the groove or step in the side edge of the decking board to hold the decking board to the support assembly. The preferred substantially parallel lower edge of the engagement arm will resist any upward movement of the decking board.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

What is claimed is:

1. A decking clip to allow a plurality of decking members to be attached relative to a support assembly, the decking clip including:

an elongate plastic body strip having a body length, the body strip provided with a number of openings to receive fasteners therethrough to attach the body strip relative to the support assembly; and a plurality of resiliently deformable upstands spaced along the body length, the upstands extending substantially perpendicularly from the body strip and substantially transversely to the body length, wherein each upstand includes:

a resiliently deformable upstand body portion with a thickened base portion and a thinner upper portion; and at least two resiliently deformable decking board engagement arms that extend outwardly and downwardly from the upstand body portion in a direction toward the body strip, a first of the decking board engagement arms extending outwardly toward a first end of the body strip and a second of the decking board engagement arms extending outwardly toward a second end of the body strip, opposite the first end, wherein the resilient deformability of the upstand body portions and engagement arms is such to allow a decking board to at least partially pass opposing engagement arms of adjacent upstands, to be inserted between the adjacent upstands, and thereafter, be retained by the opposing engagement arms of the adjacent upstands, such that neighbouring decking boards are retained relative to the support assembly in a non-overlapping configuration, spaced apart by the upstands.

2. A decking clip as claimed in claim 1, wherein the decking clip is made wholly from plastic material.

3. A decking clip as claimed in claim 1, wherein the plastic body strip is substantially planar.

4. A decking clip as claimed in claim 1, wherein a shaped key assembly is provided at one end of the plastic body strip and a correspondingly shaped keyway assembly is provided at the other end of the plastic body strip.

5. A decking clip as claimed in claim 4, wherein the key assembly and keyway assembly are provided as partial thickness portions extending only part of the height of the plastic body with the key assembly located as a half thickness portion at an upper side of the body strip and the keyway assembly provided as a half thickness portion at a lower side of the body strip.

6. A decking clip as claimed in claim 4, wherein the shaped key assembly is substantially trapezoidal in shape and the shaped keyway assembly has a corresponding shape.

7. A decking clip as claimed in claim 4, wherein at least one opening is provided through the key assembly and the keyway assembly so that when the key assembly of a first decking clip is aligned with the keyway assembly of an adjacent decking clip, at least one opening in each decking clip are aligned to allow a fastener to extend through at least one opening.

8. A decking clip as claimed in claim 1, further including a raised portion provided along each side edge of the body strip on an upper side of the body strip, to provide the body strip with raised side edges and a recessed or lower level, lower height central portion.

9. A decking clip as claimed in claim 8, wherein the raised portions are height optimised relative to a lower end of the engagement arms to account for a thickness of the decking member used.

10. A decking clip as claimed in claim 1, further including at least one transverse raised portion extending transversely to the body strip with the upstand extending from at least some of the transverse raised portions.

11. A decking clip as claimed in claim 1, further including a transversely extending attachment plate provided between adjacent upstands with at least one opening therethrough to receive a fastener to assist with attachment of the body strip relative to the support assembly.

12. A decking clip as claimed in claim 1, wherein the upstands are equi-spaced from one another.

13. A decking clip as claimed in claim 1, wherein each engagement arm has a bottom edge which is substantially parallel to the plane of the body.

14. A decking clip as claimed in claim 1, wherein the engagement arm and upstand are moulded in a single piece.

15. A decking clip as claimed in claim 1, wherein each engagement arm extends at an angle in the range of approximately 15° to approximately 35° relative to its respective upstand body portion.

* * * * *